US005748064A

United States Patent [19]

Smeenge et al.

[11] Patent Number: 5,748,064

[45] Date of Patent: May 5, 1998

[54] LOW PROFILE REACTOR

[75] Inventors: Robert E. Smeenge, Rolling Meadows; George F. Pierce, Palatine; Samuel J. Cicero, Island Lake, all of Ill.

[73] Assignee: Northrop Grumman Corporation, Los Angeles, Calif.

[21] Appl. No.: 605,411

[22] Filed: Feb. 22, 1996

[51] Int. Cl.[6] ..... H01F 15/10; H01F 27/30

[52] U.S. Cl. ..... 336/83; 29/605; 336/178; 336/192; 336/198; 336/233

[58] Field of Search ..... 29/602.1, 605, 29/606, 608; 336/83, 192, 178, 223, 233, 212, 198, 208

[56] References Cited

U.S. PATENT DOCUMENTS 1,752,866 9/1930 Trombetta ..... 336/19 L 4,887,061 12/1989 Matsumura ..... 336/178

*Primary Examiner*—Thomas J. Kozma

*Attorney, Agent, or Firm*—Terry J. Anderson; Karl J. Hoch, Jr.

[57] ABSTRACT

A low profile reactor or inductor with a spiral type of winding which conducts a high level of current for its allotted size. The present invention provides a unique two piece bobbin design in order to produce a reactor of this type in a small space with small dimensional tolerances. The two piece bobbin is designed to provide a connection to the interior terminal end of the reactor coil, which is normally difficult to accomplish because of the limited small size and area. A first bobbin piece defines a first bobbin flange, and the second bobbin piece defines a center post, providing a cylindrical winding surface, and a second bobbin flange. The center post is provided with a first recessed groove in the winding area, and the second bobbin flange is provided with a second recessed groove. A start terminal is positioned in the first and second recessed grooves below the surfaces thereof. A flat conductor reactor coil is wound upon the center post with one turn per layer, and the inner terminal end thereof is electrically connected to the start terminal. A ferrite core comprises a ferrite core base having a center post, and a ferrite core top. The first and second bobbin flanges are shaped to conform to the ferrite core base and top, with the coil being locked in place therein and prevented from rotating.

11 Claims, 4 Drawing Sheets

LOW PROFILE REACTOR

BACKGROUND OF THE INVENTION

1. Field of the Invention

The present invention relates generally to a low profile reactor, and more particularly pertains to a low profile reactor or inductor with a spiral type of winding. The reactor is adjustable, and conducts a high level of current for its allotted size. The present invention provides a unique bobbin design in order to produce a reactor of this type in a small space with small dimensional tolerances. One problem with this type of reactor or inductor is that one connection point to the reactor coil is on the inside of the coil, and an electrical connection thereto must be provided to the outside of the coil. This problem can be solved by the unique bobbin design of the present invention.

2. Discussion of the Prior Art

A normal method in the prior art for producing a coil wound onto a bobbin is to use a bobbin consisting of a tube, which provides a winding surface, with a flange at each end of the tube to contain and isolate a winding coil placed around the tube from the reactor core. These bobbins usually have a multiple number of turns for each layer of the winding coil, with the start of the winding coil wire being upended on one of the flange walls. In a normal prior art reactor design, no additional room is provided for the winding wire to extend up and out on the flange wall of the bobbin.

SUMMARY OF THE INVENTION

Accordingly, it is a primary object of the present invention to provide a low profile reactor.

A further object of the subject invention is the provision of:

1) a low profile reactor which can be easily assembled, while maximizing the available space for the reactor coil;
2) a reactor design which results in a precise location of the reactor winding coil in relation to the reactor gap, which improves the efficiency of the arrangement and reduces the generation of heat. The precise location of the reactor coil in relation to the reactor gaps is provided and maintained by the design of the reactor bobbin (reducing losses due to eddy currents and flux fringing);
3) a reactor design which maximizes the copper size of the coil winding to thereby reduce the AC and DC resistance of the coil winding. The copper size can be maximized by flattening a magnet wire to the interior width of the bobbin or by using insulated flat strips of copper conductor;
4) a bobbin design which allows the start terminal end of the coil winding to be lead out of the bobbin without impacting upon or reducing the winding area. The start terminal end is electrically connected to a start terminal positioned recessed in grooves in the center post and a flange wall of the bobbin;
5) in one variation of this design, the coil winding can be wound with a spacer positioned between adjacent coil turns to further decrease losses caused by eddy currents and proximity losses.

In accordance with the teachings herein, the present invention provides a low profile reactor having a two piece bobbin, including first and second bobbin pieces. The two piece bobbin is designed to provide for the making of a connection to an interior terminal end of the reactor coil, which is normally difficult to accomplish because of the limited small size and area. The first bobbin piece defines a first bobbin flange, and the second bobbin piece defines a center post providing a cylindrical winding surface and a second bobbin flange. The center post of the second bobbin piece is provided with a first recessed groove in the winding area, and the second bobbin flange is provided with a second recessed groove. A start terminal is positioned in the first and second recessed grooves below the surfaces of the center post and the second bobbin flange. A reactor coil includes a conductor wound upon the center post, and the inner terminal end of the reactor coil conductor is electrically connected to the start terminal. A ferrite core comprises a ferrite core base having a center post, and a ferrite core top, and the first and second bobbin flanges are shaped to conform to the ferrite core base and top, with the coil being locked in place therein and prevented from rotating.

In greater detail, the final inductance of the low profile reactor is adjusted by presetting a gap between the end of the ferrite core center post and the ferrite core top. The thickness of the first bobbin flange is larger than the preset gap, which mechanically positions the coil away from the gap to prevent flux fringing at the gap from entering into the coil conductor, which would set up eddy currents or proximity effect losses and produce undesired heat and lower the efficiency of operation of the low profile reactor.

The reactor coil is preferably wound upon the center post with one turn per layer of an insulated flat conductor wherein the insulated flat conductor maximizes filling of the winding space provided by the bobbin. In one embodiment the insulated flat conductor has a width approximately twice its thickness. In some embodiments, an additional layer of insulation can be inserted into the reaction coil between adjacent turns of the reactor coil conductor.

In greater detail, the second terminal end of the reactor core winding is connected to a terminal positioned on the first bobbin flange. The ferrite core base and top are constructed of a ceramic material having iron metallic particles therein, and are formed by molding and machining operations. In one designed embodiment, the low profile reactor has a height of approximately 0.2 inches and a length and width of approximately 0.75 inches.

During assembly of the low profile reactor, an electrical solder connection is made from the inner terminal end of the reactor coil conductor to the start terminal before the bobbin is assembled from the first and second bobbin pieces, with nothing preventing or hindering the use of a soldering iron. Thereafter the first bobbin piece is positioned and aligned relative to the second bobbin piece by fitting a notch in the first bobbin piece into a groove in the second bobbin piece. The first and second bobbin pieces are then secured together as by glueing, the required number of turns of the conductor are wound onto the reactor coil, one turn per layer to form a flat spiral coil, and a second terminal end of the conductor is connected to a terminal on the first bobbin flange.

BRIEF DESCRIPTION OF THE DRAWINGS

The foregoing objects and advantages of the present invention for a low profile reactor may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
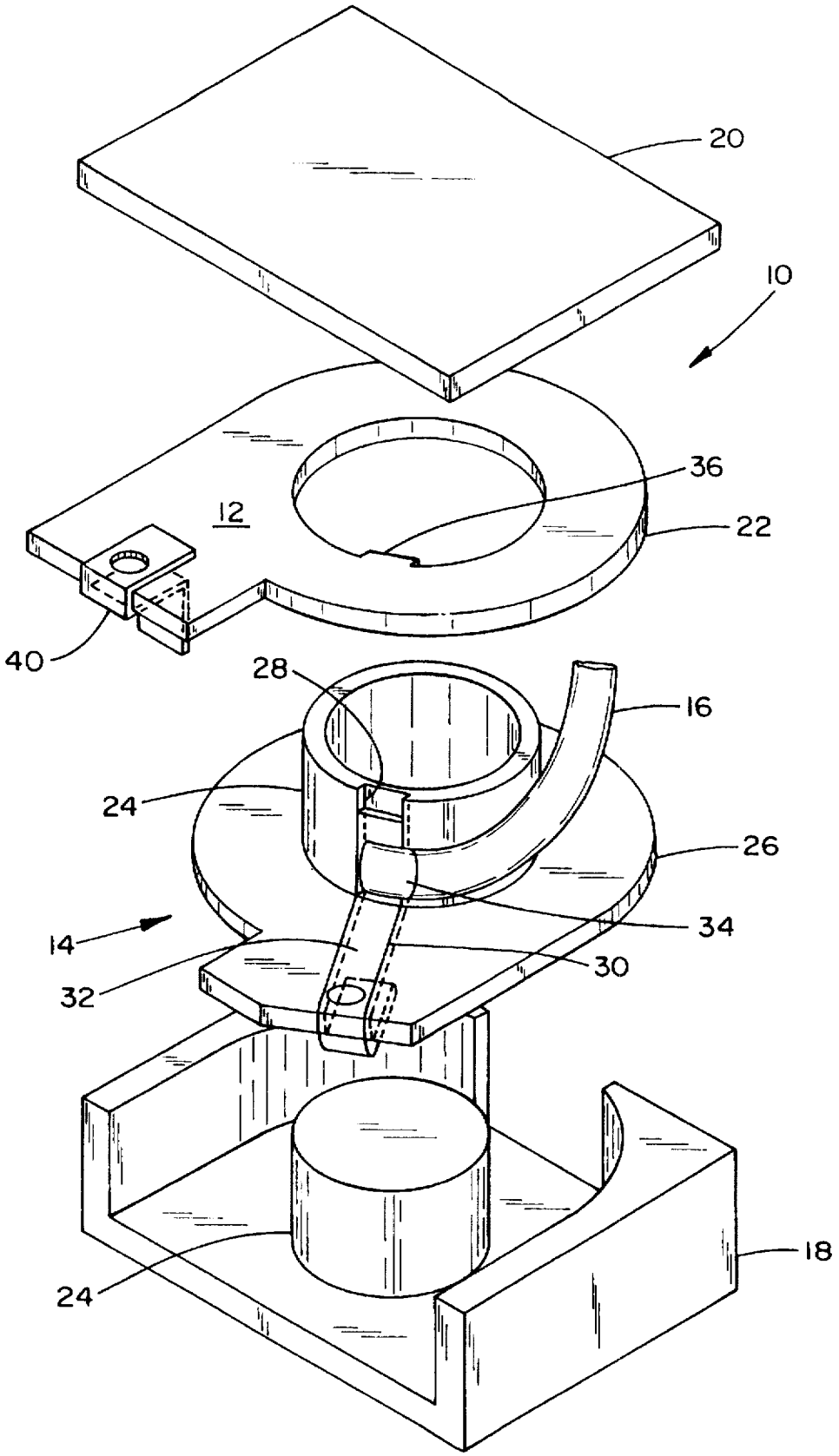
FIG. 1 illustrates an exploded view of a preferred design of a low profile reactor, and shows a two piece bobbin construction, to enable a flat winding of coil wire to be easily fitted thereon, and a two piece reactor core construction.

Referring to the drawings in detail, FIG. 1 illustrates an exploded view of a preferred design of a low profile reactor or inductor 10 pursuant to the present invention. FIG. 1 also shows a preferred two piece bobbin construction 12, 14, which enables a flat winding of coil wire 16 to be easily fitted thereon, and a two piece reactor core construction 18, 20.

The low profile reactor design of the present invention includes a two piece bobbin which is designed to provide for the making of a connection to an interior terminal end of the reactor coil, which is normally difficult to accomplish because of its small size and limited area.

Figure 4:
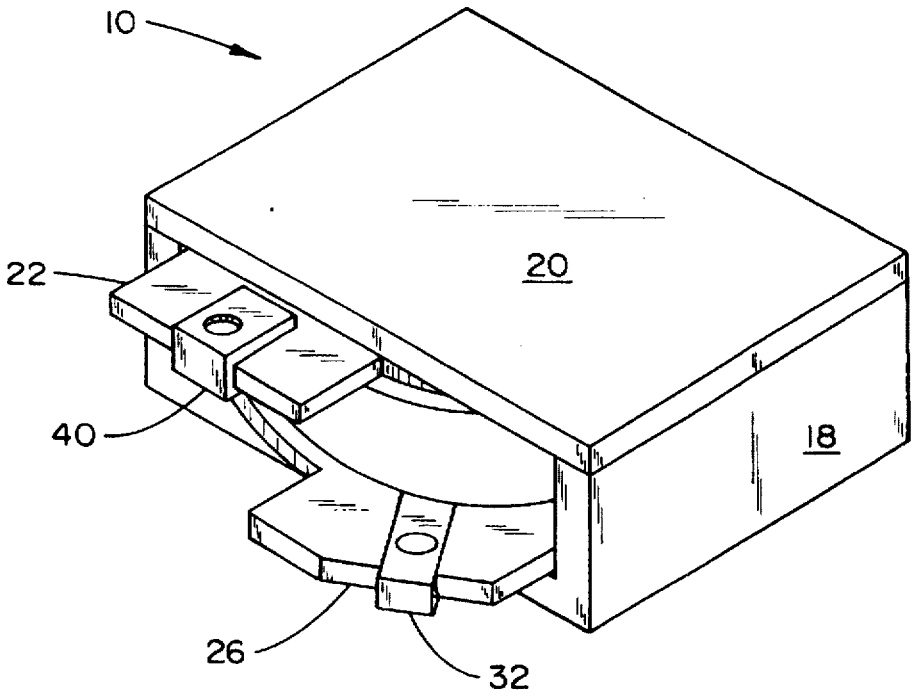
FIG. 4 illustrates a perspective view of an assembled low profile reactor pursuant to the teachings of the present invention.

The low profile reactor design of the present invention relates to a finished reactor as shown best in FIG. 4, which in one designed embodiment had a height of approximately 0.2 inches, and a length and width of approximately 0.75 inches. The design provides room for one turn per layer of an insulated covered flat conductor for the reactor coil which is wound in the manner of a spiral spring. In a normal prior art reactor design, no room is provided for the coil conductor to extend up and out on the flange wall of the bobbin. The design of the low profile reactor of the present invention, particularly the design of the low profile bobbin therein, provides such room without impacting upon and reducing the winding area provided by the bobbin.

The low profile bobbin is designed with two bobbin pieces 12 and 14 which fit together and are then locked in place, as by glueing. The first bobbin piece 12 provides a first bobbin flange 22, and the second bobbin piece 14 provides a cylindrical winding surface on a center post 24 and a second flange 26. A first recessed groove 28 is provided on the center post 24 of the second bobbin piece 14 in the winding area, and a second recessed groove 30 is provided in the second bobbin flange. A start terminal 32 is positioned in the recessed grooves 28, 30 below the surfaces of the center post and the second bobbin flange.

With the two pieces of the bobbin separated, as illustrated in FIG. 1, the inner terminal end 34 of the flat conductor 16 of the coil can be easily connected to the start terminal 32 with solder. Once the connection is made, the first bobbin piece 12 can be fitted and snapped into place on the second bobbin piece 14, with a notch 36 on the first bobbin piece 12 fitting into the top of the groove 28 on the second bobbin piece 14.

Figure 3:
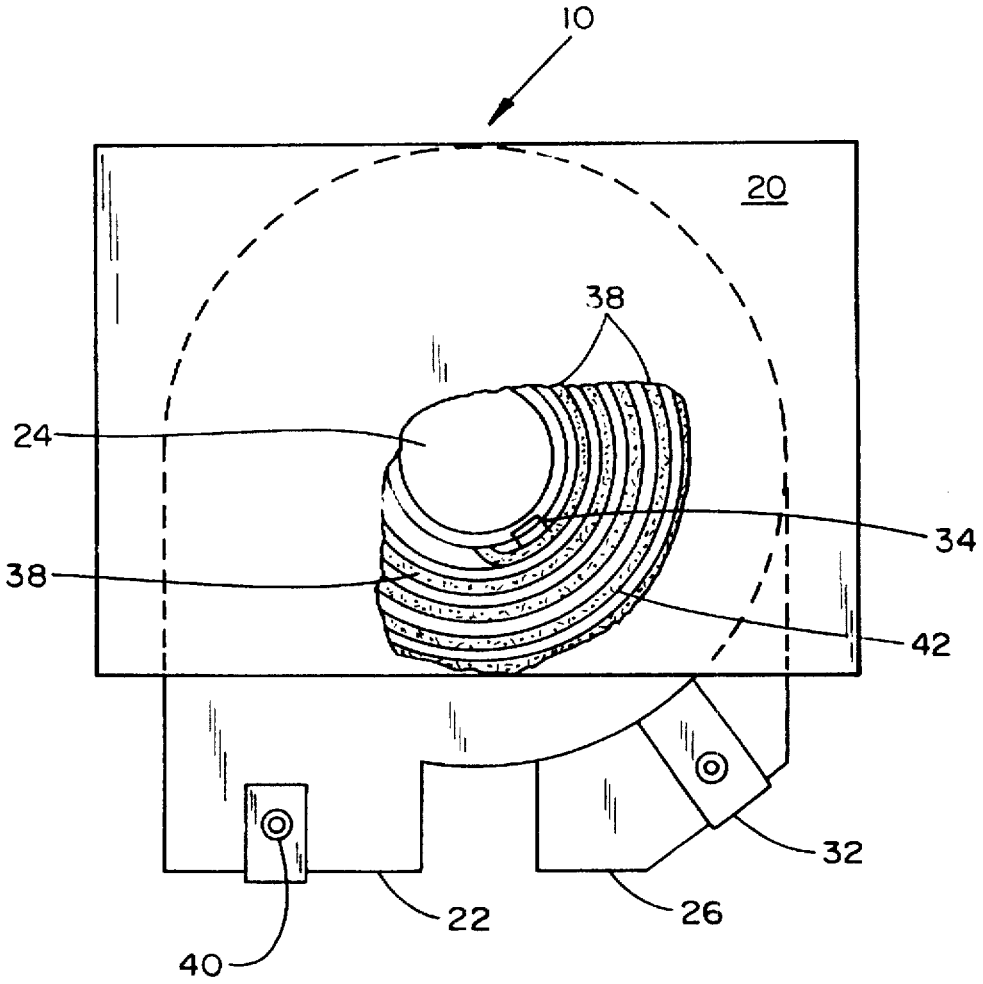
FIG. 3 is a top plan view of an assembled low profile reactor which is partially cut away to illustrate the coil winding therein.

The two bobbin pieces 12 and 14 are then secured together as by glueing, and the flat conductor 16 can then be wound into a winding 38 as illustrated in FIG. 3. The second terminal end of the winding is connected to a finish terminal 40 positioned on the first bobbin flange 22. If a separate layer of insulation 42 is required, as illustrated in the cut out of FIG. 3, it can be inserted along with the conductor during the coil winding operation.

The ferrite core comprises a core base 18, having a center post 24, and a core top 20. The ferrite core base 18 and top 20 are constructed of a ceramic material having iron metallic particles therein, and can be formed by molding and machining operations.

The bobbin flanges 22 and 26 are shaped to conform to the shaped ferrite core base and top 18, 20, and after assembly the coil is locked in place and prevented from rotating.

The first and second bobbin pieces 12, 14 can be either cast or machined to shape from an appropriate plastic insulating material. The start and finish terminals are plated copper and the start terminal is dimensioned to fit in the recessed grooves in the bobbin flange and winding tube.

For the flat conductor 16, a round magnet wire can be flattened to have a width approximately the width of the winding space thereof, or a copper strap can be cut and insulated to the width of the winding area. A flat conductor is used to maximize the filling of the winding space in the bottom by the conductor to make the most effective use of the available area.

Figure 2:
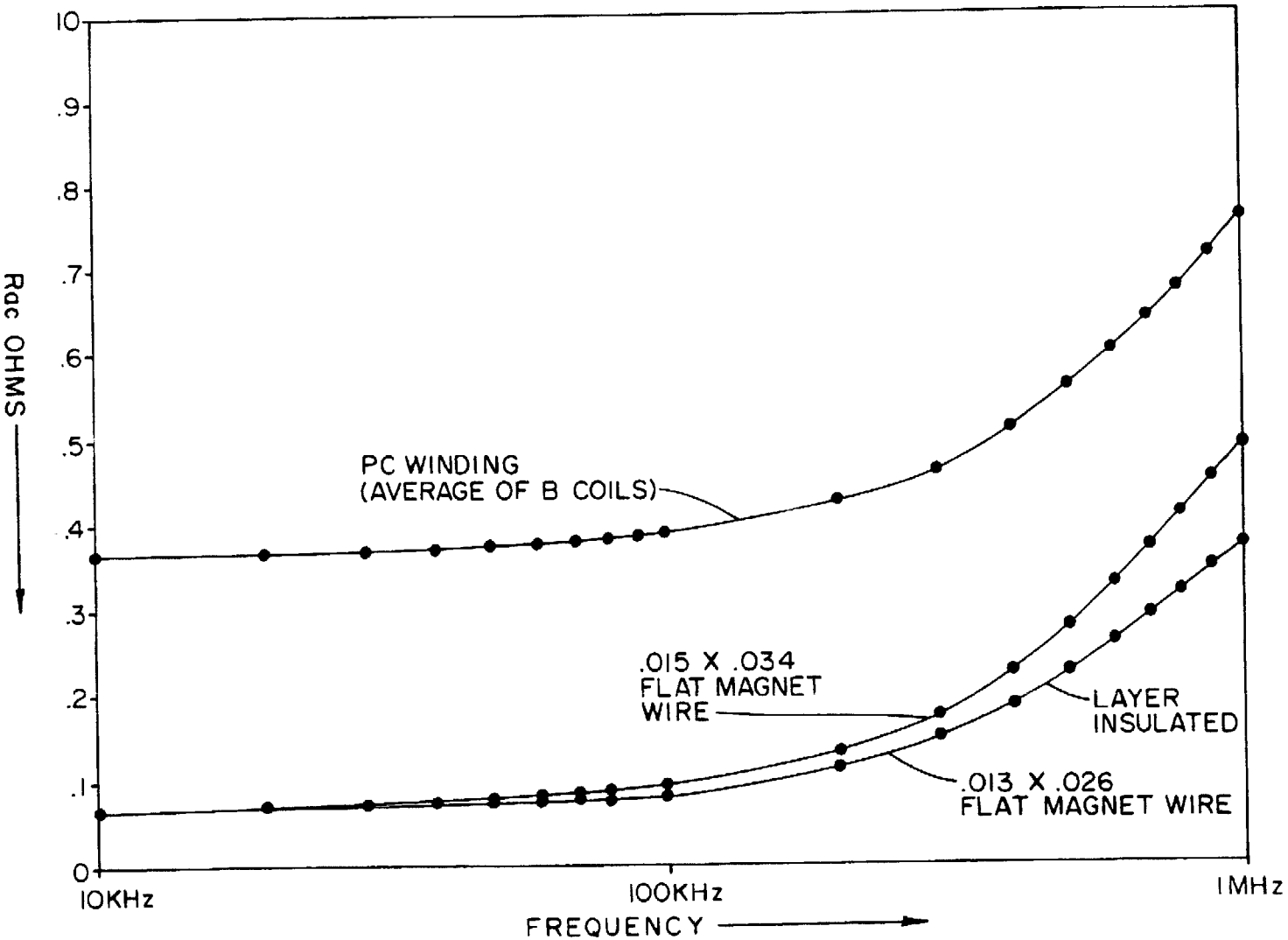
FIG. 2 illustrates several graphs of the AC resistance of ten turn coils of equal size of a printed circuit (PC) winding, a flat magnet wire, and a flat magnet winding with a separating layer of insulation between adjacent turns thereof.

FIG. 2 illustrates several graphs of the AC resistance of ten turn coils of equal size of a printed circuit (PC) winding, a flat magnet wire, and a flat magnet winding with a separating layer of insulation between adjacent turns thereof. FIG. 2 illustrates a comparison of AC resistance values using flattened wire versus AC resistance values using printed circuit winding techniques. The finished coils represented in FIG. 2 are identical in turns and physical size. FIG. 2 illustrates that the AC resistance is less at higher frequencies when using a coil winding wire with a smaller cross-sectional area with insulation provided between adjacent turns.

Construction of the low profile reactor is started by stripping the inner terminal end of the conductor 16 and making an electrical connection, as by soldering, to the start terminal 32. This connection is easily made because the bobbin is still unassembled and open, as illustrated in FIG. 1, with nothing preventing or hindering the use of a soldering iron. The first bobbin piece 12 can now be positioned and aligned relative to the second bobbin piece 14 by fitting notch 36 into groove 28, and glueing the two aligned pieces in place. The required number of turns can now be wound onto the coil, one turn per layer, as illustrated in FIGS. 1 and 3. To finish the coil, the conductor is cut to an appropriate length, the insulation is stripped from the cut end, and the stripped end is connected as by soldering to the finish terminal 40 provided on the flange 22 of the top bobbin piece 12. This forms a flat spiral coil.

FIG. 4 illustrates a perspective view of the final assembled configuration of the low profile inductor 10.

The two piece design of the bobbin serves an additional function. The final inductance of the low profile inductor 10 is adjusted by presetting, as by machining or grinding, a gap between the end surface of the center post 24 of the core base 18 and the core top 20. The thickness of the flange 22 (approximately 30 mils) is designed to be larger than the preset gap, which mechanically positions the coil away from the gap to prevent or reduce flux fringing at the gap from entering into the copper conductor. Fringing flux in the copper would set up eddy currents or proximity effect losses which can produce undesired heat and lower the overall efficiency of the circuit.

While several embodiments and variations of the present invention for a low profile reactor are described in detail herein, it should be apparent that the disclosure and teachings of the present invention will suggest many alternative designs to those skilled in the art.

What is claimed is:

1. A low profile reactor comprising:

a. a two piece bobbin, including first and second bobbin pieces, which is designed to provide for the making of a connection to an interior terminal end of a reactor coil, wherein the first bobbin piece includes a first bobbin flange, and the second bobbin piece includes a center post providing a cylindrical winding surface and a second bobbin flange, and the center post of the second bobbin piece is provided with a first recessed groove in the winding area, and the second bobbin flange is provided with a second recessed groove;

b. a start terminal positioned in the first and second recessed grooves below the surfaces of the center post and the second bobbin flange;

c. a reactor coil comprising a conductor wound upon the center post, and wherein an inner terminal end of the reactor coil conductor is electrically connected to the start terminal; and d. a ferrite core comprising a ferrite core base having a center post, and a ferrite core top, wherein the first and second bobbin flanges are shaped to conform to the ferrite core base and top, with the coil being locked in place therein and prevented from rotating.

2. A low profile reactor as claimed in claim 1, wherein the final inductance of the low profile reactor is adjusted by presetting a gap between the end of the ferrite core center post and the ferrite core top.

3. A low profile reactor as claimed in claim 2, wherein the gap is preset to approximately 20 mils.

4. A low profile reactor as claimed in claim 2, wherein the thickness of the first bobbin flange is larger than the gap, which mechanically positions the coil away from the gap to prevent flux fringing at the gap from entering into the coil conductor, which would set up eddy currents or proximity effect losses and produce undesired heat and lower the efficiency of operation of the low profile reactor.

5. A low profile reactor as claimed in claim 1, wherein a layer of insulation is inserted into the wound reaction coil between adjacent turns of the reactor coil conductor.

6. A low profile reactor as claimed in claim 1, wherein a second terminal end of the reactor coil winding is connected to a terminal positioned on the first bobbin flange of the first bobbin piece.

7. A low profile reactor as claimed in claim 1, wherein the conductor comprises a flat conductor.

8. A low profile reactor as claimed in claim 1, wherein the ferrite core base and top are constructed of a ceramic material having iron metallic particles therein, and are formed by molding and machining operations.

9. A low profile reactor as claimed in claim 1, wherein the low profile reactor has a height of approximately 0.2 inches and a length and width of approximately 0.75 inches.

10. A low profile reactor as claimed in claim 1, wherein the reactor coil is wound upon the center post with one turn per layer of an insulated flat conductor, wherein the insulated flat conductor maximizes filling of the winding space provided by the bobbin.

11. A method of constructing a low profile reactor as claimed in claim 1, wherein an electrical solder connection is made from the inner terminal end of the reactor coil conductor to the start terminal before the bobbin is assembled from the first and second bobbin pieces, with nothing preventing or hindering the use of a soldering iron, thereafter the first bobbin piece is positioned and aligned relative to the second bobbin piece by fitting a notch in the first bobbin piece into a groove in the second bobbin piece, and the first and second bobbin pieces are secured together, the required number of turns of the conductor are wound onto the reactor coil, one turn per layer to form a flat spiral coil, and second terminal end of the conductor is connected to a terminal on the first bobbin flange.

* * * * *